US009421564B2

(12) United States Patent
Deng

(10) Patent No.: US 9,421,564 B2
(45) Date of Patent: Aug. 23, 2016

(54) DISPENSING SPRAY PUMP FOR FLUID PREPARATION

(71) Applicant: Shenzhen Bona Medicinal Packaging Material Co.Ltd., Shenzhen (CN)

(72) Inventor: Yunhua Deng, Shenzhen (CN)

(73) Assignee: BONA PHARMA TECHNOLOGY CO., LTD., Guangdong (CN)

( * ) Notice: Subject to any disclaimer, the term of this patent is extended or adjusted under 35 U.S.C. 154(b) by 184 days.

(21) Appl. No.: 14/378,831

(22) PCT Filed: Sep. 10, 2013

(86) PCT No.: PCT/CN2013/083193

§ 371 (c)(1),
(2) Date: Aug. 14, 2014

(87) PCT Pub. No.: WO2014/059839

PCT Pub. Date: Apr. 24, 2014

(65) Prior Publication Data

US 2015/0053792 A1 Feb. 26, 2015

(30) Foreign Application Priority Data

Oct. 15, 2012 (CN) ..... 2012 1 0388633

(51) Int. Cl.
*B05B 9/08* (2006.01)
*B05B 9/047* (2006.01)
*B05B 11/00* (2006.01)

(52) U.S. Cl.
CPC ..... *B05B 9/047* (2013.01); *B05B 9/0838* (2013.01); *B05B 11/3001* (2013.01); *B05B 11/3004* (2013.01); *B05B 11/3074* (2013.01)

(58) Field of Classification Search
CPC ..... B05B 11/3046; B05B 11/3047; B05B 11/3043; B05B 11/305; B05B 11/3049
USPC ..... 239/302–349; 222/321.6, 321.2
See application file for complete search history.

(56) References Cited

U.S. PATENT DOCUMENTS 6,062,433 A * 5/2000 Fuchs ..... B05B 11/0016 222/153.13
6,250,509 B1 * 6/2001 Fuchs ..... B05B 11/0021 222/321.6
6,308,867 B1 * 10/2001 Wolter ..... B05B 11/3053 222/321.6

* cited by examiner

*Primary Examiner* — Len Tran
*Assistant Examiner* — Tuongminh Pham
(74) *Attorney, Agent, or Firm* — Oliff PLC

(57) ABSTRACT

A dispensing spray pump includes a first piston located inside a second piston. The first piston and the second piston are enclosingly connected, and a chamber with an enclosed bottom is formed between the pistons. The pump body includes first and second pump bodies that are barrel-shaped and arranged in identical axial directions. The first pump body is inside the second pump body, and the first and second pump bodies are fixedly connected via a radial grid. A fluid channel is between the outer wall of the first pump body and the inner wall of the second pump body, and the first and second pistons are slidable in the pump bodies in a sealed manner, respectively. A first chamber is formed between the check valve and the first piston, and the chamber with the enclosed bottom is in communication with the fluid channel to form a second chamber.

5 Claims, 2 Drawing Sheets

DISPENSING SPRAY PUMP FOR FLUID PREPARATION

BACKGROUND OF THE PRESENT INVENTION

1. Field of Invention

The present invention relates to a fluid pumping device, in particular to a dispensing spray pump for fluid preparation.

2. Description of Related Arts

A spray pumping device for fluid preparation has been widespread used in the fields of medical treatment, cosmetic, perfume, etc., for dispensing and squirting the fluid preparation to form a spray. The fluid dispensing pumps, disclosed as in patent number CN 200680044054.1, patent application number CN 200980126767.6 and patent application number 201110308177.4, mainly include a water core, a piston and a dispensing head, the water core includes a plunger and a pump body, the plunger is clogged at a dispensing hole of the dispensing head, and the pump body has a chamber and is provided with a secondary piston consisting of annular rings on the exterior surface; the piston is fixed to the bottle mouth of the reagent bottle with fluid preparation through a fixing ring, the piston can move forth and back in the chamber in a sealing manner, the secondary piston is slidably disposed in the dispensing chamber of the dispensing head; the chamber is communicated with the dispensing chamber, the piston is slid in the chamber to discharge the fluid preparation into the dispensing chamber, the hydraulic pressure of the dispensing chamber increases to push the secondary piston sliding in the dispensing chamber to coordinate the plunger for breaking away from the dispensing hole, thereby dispensing outward a dose of fluid preparation.

Although the fluid dispensing pump as described above may pump drugs well, the structure itself has certain design defects, such as:

First, the water core in the above fluid dispensing pump consists of a plunger and a pump body being integrally formed, thereby resulting in a water core with complex structure and longer size. The corresponding piston requires moving forth and back in the pump body, and then forms a hydraulic device by combining the pump body; therefore, the piston also requires a length being matched with the pump body. Since both the water core and the piston adopt injection molding process, the long size would increase the difficulty in injection molding and withdrawal in the case of the requirement of guaranteeing precision.

Second, in the above fluid dispensing pump, the piston needs to move forth and back in the pump body in a sealing manner, moreover, a starting air channel is required to reserve between the outer wall of the piston and the inner wall of the pump body while the piston achieves in sealed sliding, which undoubtedly further increases the required precision of the pump body and the piston during the machining process, and is not conducive to improve production efficiency.

Aiming at the above defects of the structure of the existing fluid dispensing pump in practice, it is necessary to make further improvement of the prior art. The present invention is an improvement approach with regard to the defects.

SUMMARY OF THE PRESENT INVENTION

The present invention provides a dispensing spray pump for fluid preparation, which is a device with the identical property of the traditional fluid dispensing pump. The main technical problem to be solved herein is that: since the existing fluid dispensing pumps have long size due to the defect of the structure, and need to reserve a starting air channel, the machining accuracy thereof is much higher, thereby increasing the machining difficulty. The above are the main technical problems to be solved in the present invention.

In order to solve the above technical problems, the technical solution adopted in the present invention is that: the present invention provides a dispensing spray pump for fluid preparation, which is arranged at a liquid storage bottle filling with the fluid preparation, including a piston body, a pump body, a plunger and a dispensing head, the piston body is fixedly arranged at the bottle mouth of the liquid storage bottle through a sealed cap, the piston body includes a first piston and a second piston, which are barrel-shaped and arranged in an identical axial direction, the first piston is located inside the second piston, the bobbin of the first piston is in communication with an immersed tube, the ends of the first piston and the second piston are enclosingly connected one another, a chamber with an enclosing bottom is formed between the outer wall of the first piston and the inner wall of the second piston; the pump body includes a first pump body and a second pump body, which are barrel-shaped and arranged in an identical axial direction, the first pump body is located inside the second pump body, the first pump body and the second pump body are fixedly connected to one another via a radial grid, and there is a fluid channel between the outer wall of the first pump body and the inner wall of the second pump body; the first piston and the second piston are slid in the first pump body and the second pump body in a sealed manner, respectively, the first pump body is provided with a check valve, a first chamber is formed between the check valve and the first piston in the first pump body, the check valve can only open outward unidirectionally from the first chamber, the depth from the chamber mouth of the first chamber to the check valve is less than the maximum stroke of the first piston, as the first piston reaches the top dead centre, it enables to lift the check valve, the bobbin of the first pump body is inserted in the chamber between the second piston and the first piston, the external diameter of the first pump body is less than the inner diameter of the second piston, the second piston is slid in the fluid channel located between the first pump body and the second pump body, the chamber with an enclosing bottom is in communication with the fluid channel to form a second chamber; an end of the plunger is fixedly inserted in the other end of the second pump body that is corresponding to the second piston, the plunger is provided with an communicating hole that is in communication with the second chamber.

Preferably, an outer axial surface of the pump body is provided with a secondary piston with an annular ring shape, a dispensing chamber is surrounded by the secondary piston, the outer wall of the plunger and the inner wall of the dispensing head, the communicating hole of the plunger is in communication with the second chamber and the dispensing chamber.

Preferably, the dispensing head is a nozzle suitable for the human nose, the top of the dispensing head is provided with a dispensing hole that is in communication with the inner chamber and the outer of the dispensing head, the pump body and the plunger are arranged axially and slid in the dispensing head, the plunger is arranged in the dispensing head and is located in the upstream of the dispensing hole, and is movable between the closed position and the open position of the dispensing hole, the pump body is kept by an elastic component to push the plunger to clog at the closed position of the dispensing hole.

Preferably, the dispensing chamber is provided with a bushing therein at the position corresponding to the plunger, the plunger is slidably inserted in the bushing, the bushing is interference fit with the inner wall of the dispensing head, a fixed spray-typed unit is reserved between the top of the bushing and the dispensing hole, the top of the bushing is provided with a discharge hole, which is in communication with the dispensing chamber and the spray-typed unit, the plunger keeps and clogs the discharge hole under the action of the elastic component.

Compared to the prior art, the beneficial effects generated by the present invention is that: the present invention provides a dispensing spray pump for fluid preparation, which, in practice, divides the water core component in the dispensing pump into a pump body and a plunger, which can be injection molding respectively to simplify the various difficulties in the integrated manufacturing process. Besides, by arranging the check valve in the first pump body of the pump body, the invention lifts the check valve through the upstream of the first piston, and achieves in discharging the starting air in the pump body to the liquid storage bottle through the bobbin of the first piston and the immersed tube, thereby omitting the structure to reserve the starting air channel, simplifying the processing technology, which enables to effectively improve production efficiency.

DETAILED DESCRIPTION OF THE PREFERRED EMBODIMENTS

Hereinafter, the dispensing spray pump for fluid preparation provided by the present invention will be described in more details by combining with the FIGS. 1 to 2, and the preferred embodiment.

Figure 1:
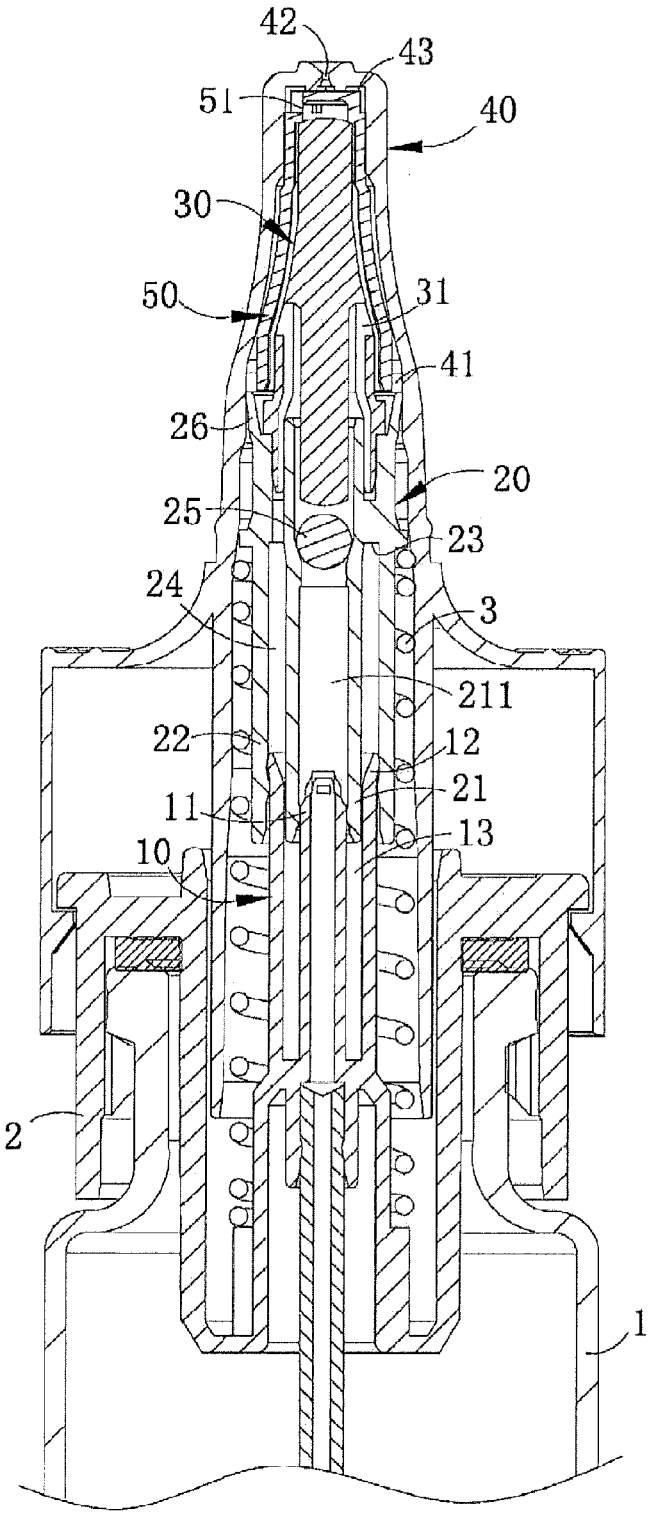
FIG. 1 is a cross-sectional schematic view of the present invention.
Figure 2:
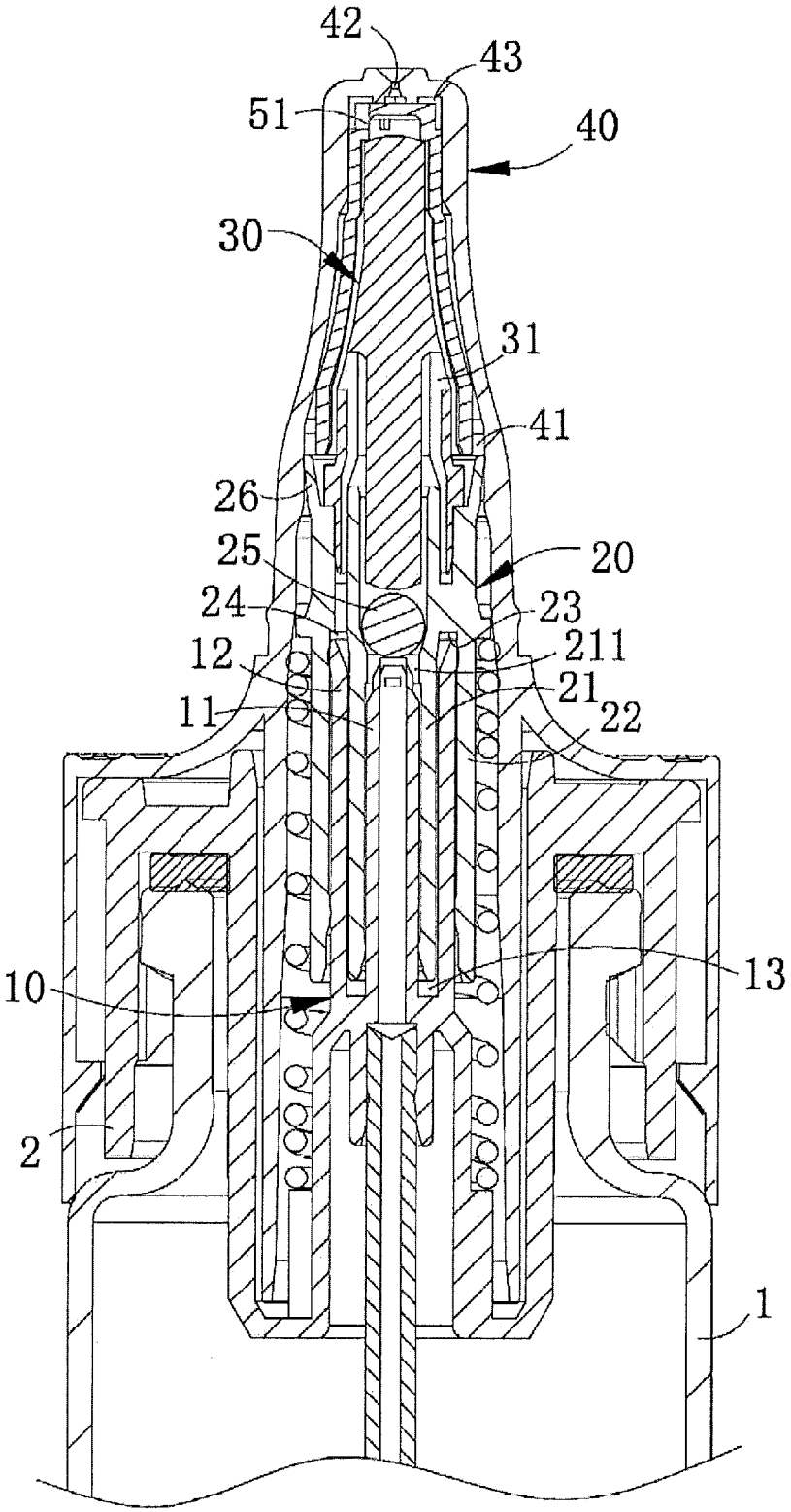
FIG. 2 is a cross-sectional schematic view of a start-up exhaust condition of the present invention.

As shown in FIGS. 1 and 2, the present invention provides a dispensing spray pump for fluid preparation, which is arranged at a liquid storage bottle 1 filled with the fluid preparation, including a piston body 10, a pump body 20, a plunger 30 and a dispensing head 40, characterized in that:

The piston body 10 is fixedly arranged at the bottle mouth of the liquid storage bottle 1 through a sealed cap 2, the piston body 10 includes a first piston 11 and a second piston 12, which are barrel-shaped and arranged in an identical axial direction, the first piston 11 is located inside the second piston 12, the bobbin of the first piston 11 is in communication with an immersed tube, the ends of the first piston 11 and the second piston 12 are enclosingly connected to one another, a chamber 13 with an enclosed bottom is formed between the outer wall of the first piston 11 and the inner wall of the second piston 12.

The pump body 20 includes a first pump body 21 and a second pump body 22, which are barrel-shaped and arranged in an identical axial direction, the first pump body 21 is located inside the second pump body 22, the first pump body 21 and the second pump body 22 are fixedly connected to one another via a radial grid 23, and there is a fluid channel 24 between the outer wall of the first pump body 21 and the inner wall of the second pump body 22.

The first piston 11 and the second piston 12 are slidable in the first pump body 21 and the second pump body 22 in a sealed manner, respectively; the first pump body 21 is provided with a check valve 25, a first chamber 211 is formed between the check valve 25 and the first piston 11 in the first pump 21, the check valve 25 can only open outward unidirectionally from the first chamber 211, the depth from the chamber mouth of the first chamber 211 to the check valve 25 is less than the maximum stroke of the first piston 11, as the first piston 11 reaches the top dead centre, it enables to lift the check valve 25, the bobbin of the first pump body 21 is inserted in the chamber 13 between the second piston 12 and the first piston 11, the external diameter of the first pump body 21 is less than the inner diameter of the second piston 21, the second piston 12 is slid in the fluid channel 24 located between the first pump body 21 and the second pump body 22, the chamber 13 with an enclosed bottom is in communication with the fluid channel 24 to form a second chamber.

An outer axial surface of the pump body 20 is provided with a secondary piston 26 with an annular ring shape, a dispensing chamber 41 is surrounded by the secondary piston 26, the outer wall of the plunger 30 and the inner wall of the dispensing head 40.

An end of the plunger 30 is fixedly inserted in the other end of the second pump body 22 that is corresponding to the second piston 12, the plunger 30 is provided with a communicating hole 31 that is in communication with the second chamber, the communicating hole 31 is in communication with the second chamber and the dispensing chamber 41.

The dispensing head 40 is a nozzle suitable for the human nose, the top of the dispensing head 40 is provided with a dispensing hole 42 that is in communication with the inner chamber and the outer of the dispensing head 40, the pump body 20 and the plunger 30 are arranged axially and slidable in the dispensing head 40, the plunger 30 is arranged in the dispensing head 40 and is located in the upstream of the dispensing hole 42, and is movable between the closed position and the open position of the dispensing hole 42, the pump body 20 is kept by an elastic component 3 to push the plunger 30 to clog at the closed position of the dispensing hole 42.

When in practice, the present invention divides the water core component in the dispensing pump into a pump body 20 and a plunger 30, which can be injection molding respectively to simplify the various difficulties in the integrated manufacturing process. Besides, by arranging the check valve 25 in the first pump body 21 of the pump body 20, the invention lifts the check valve 25 through the upstream of the first piston 11, and achieves in discharging the starting air in the pump body 20 to the liquid storage bottle 1 through the bobbin of the first piston 11 and the immersed tube, thereby omitting the structure to reserve the starting air channel, simplifying the processing technology, which enables to effectively improve production efficiency.

Preferred embodiment: the dispensing chamber 41 is provided with a bushing 50 therein at the position corresponding to the plunger 30, the plunger 30 is slidably inserted in the bushing 50, the bushing 50 is interference fit with the inner wall of the dispensing head 40, a fixed spray-typed unit 43 is reserved between the top of the bushing 50 and the dispensing hole 42, the top of the bushing 50 is provided with a discharge hole 51, the discharge hole 51 is in communication with the dispensing chamber 41 and the spray-typed unit 43, the plunger 30 keeps and clogs the discharge hole 51 under the action of the elastic component 3.

To sum up, the technical solution of the present invention can sufficiently and effectively accomplish the object of the above invention, and the structure principle and the function principle of the invention have been sufficiently verified in the embodiment to achieve the expected effect and object. The embodiment of the present invention may be changed according to the principle; therefore, the invention includes all alternative contents referred in the application patent's scope. Any equivalent change on basis of the application patent's scope belongs to the scope of the present patent application.

What is claimed is:

1. A dispensing spray pump for a liquid storage bottle filled with a fluid preparation, comprising a piston body, a pump body, a plunger and a dispensing head, wherein:

the piston body is fixable to a bottle mouth of the liquid storage bottle through a sealed cap, the piston body comprises a first piston and a second piston, which are barrel-shaped and arranged in an identical axial direction, the first piston is located inside the second piston, a bobbin of the first piston is in communication with an immersion tube, the ends of the first piston and the second piston are enclosingly connected to one another, and a chamber with an enclosed bottom is formed between the outer wall of the first piston and the inner wall of the second piston;

the pump body comprises a first pump body and a second pump body, which are barrel-shaped and arranged in an identical axial direction, the first pump body is located inside the second pump body, the first pump body and the second pump body are fixedly connected to one another via a radial grid, and there is a fluid channel between an outer wall of the first pump body and an inner wall of the second pump body;

the first piston and the second piston are slidable in the first pump body and the second pump body in a sealed manner, respectively, the first pump body is provided with a check valve, a first chamber is formed between the check valve and the first piston in the first pump body, the check valve can only open outward unidirectionally from the first chamber, the depth from a chamber mouth of the first chamber to the check valve is less than the maximum stroke of the first piston, the first piston is configured to lift the check valve when the first piston reaches top dead centre, a bobbin of the first pump body is inserted in the chamber between the second piston and the first piston, an external diameter of the first pump body is less than an inner diameter of the second piston, the second piston is slidable in the fluid channel located between the first pump body and the second pump body, and the chamber with the enclosed bottom is in communication with the fluid channel to form a second chamber; and an end of the plunger is fixedly inserted in the other end of the second pump body that is corresponding to the second piston, and the plunger is provided with a communicating hole that is in communication with the second chamber.

2. The dispensing spray pump according to claim 1, wherein an outer axial surface of the pump body is provided with a secondary piston with an annular ring shape, a dispensing chamber is surrounded by the secondary piston, an outer wall of the plunger and an inner wall of the dispensing head, and the communicating hole of the plunger is in communication with the second chamber and the dispensing chamber.

3. The dispensing spray pump according to claim 2, wherein the dispensing head is a nozzle suitable for the human nose, the top of the dispensing head is provided with a dispensing hole that is in communication with an inner chamber of the dispensing head, the pump body and the plunger are arranged axially and slidable in the dispensing head, the plunger is movable between the closed position and the open position of the dispensing hole, and an elastic component within the pump body is configured to push the plunger towards the dispensing hole.

4. The dispensing spray pump according to claim 3, wherein the dispensing chamber is provided with a bushing therein at a position corresponding to the plunger, the plunger is slidably inserted in the bushing, the bushing is interference fit with the inner wall of the dispensing head, a fixed spray-typed unit is reserved between the top of the bushing and the dispensing hole, the top of the bushing is provided with a discharge hole, which is in communication with the dispensing chamber and the spray-typed unit, and the plunger opens and closes the discharge hole under the action of the elastic component.

5. A liquid storage bottle filled with a fluid preparation comprising a bottle mouth and the dispensing spray pump according to claim 1 fixed to the bottle mouth through a sealed cap.

* * * * *